United States Patent [19]

Thomas

[11] 4,304,279

[45] Dec. 8, 1981

[54] AIRPLANE WHEEL AND BEARING PROTECTOR

[76] Inventor: William A. Thomas, 6900 Firmament Ave., Van Nuys, Calif. 91406

[21] Appl. No.: 103,760

[22] Filed: Dec. 14, 1979

Related U.S. Application Data

[63] Continuation-in-part of Ser. No. 21,036, Mar. 16, 1979, abandoned.

[51] Int. Cl.[3] ..... B65D 85/06

[52] U.S. Cl. ..... 150/54 B; 206/304; 244/103 R

[58] Field of Search ..... 244/103 R; 301/37 SA, 301/37 P, 37 S, 37 SC; 224/42.2, 42.6; 206/304; 150/54 A, 54 B; 70/259, 260; 85/1 H; 292/59, 62; 220/327, 325, 4 E, 4 B

[56] References Cited

U.S. PATENT DOCUMENTS

| | | | |
|---|---|---|---|
| 452,776 | 5/1891 | Doty | 292/62 |
| 541,944 | 7/1895 | Palmer | 220/325 |
| 1,234,387 | 7/1912 | Pugh et al. . | |
| 1,289,908 | 12/1918 | Pugh . | |
| 1,351,261 | 8/1920 | Miller . | |
| 1,379,297 | 5/1921 | Draver | 224/42.2 |
| 1,393,992 | 10/1921 | Farkas | 220/244 |
| 1,456,962 | 5/1923 | Baker | 150/54 A |
| 1,582,595 | 4/1926 | Goldsmith . | |
| 1,589,806 | 6/1926 | Kayuk . | |
| 1,607,778 | 11/1926 | Noreau | 150/54 A |
| 1,658,696 | 2/1928 | Walrath | 150/54 A |
| 1,712,590 | 5/1929 | Sutherland . | |
| 1,720,415 | 7/1929 | Hammond | 224/42.2 |
| 1,861,432 | 6/1932 | Barber . | |
| 1,928,882 | 10/1933 | Coppock . | |
| 1,992,671 | 2/1935 | Lyon | 150/54 A |
| 2,106,586 | 1/1938 | Zerk | 70/259 X |
| 2,230,193 | 1/1941 | Shinn | 301/37 S X |
| 3,004,798 | 10/1961 | Tylle . | |
| 3,297,153 | 1/1967 | Fattori | 220/32 S X |

FOREIGN PATENT DOCUMENTS

| | | | |
|---|---|---|---|
| 653952 | 12/1962 | Canada | 220/327 |
| 252274 | 3/1927 | Italy . | |
| 436894 | 6/1948 | Italy | 301/37 SC |

*Primary Examiner*—Allan N. Shoap

*Attorney, Agent, or Firm*—Nilsson, Robbins, Dalgarn, Berliner, Carson & Wurst

[57] ABSTRACT

A wheel and bearing protector apparatus useful in protecting airplane wheels and bearings from damage or contamination and for preventing loss of bearings during handling prior to mounting on an airplane axle. The apparatus has two wheel and bearing protectors for being mounted on opposite sides of a wheel. Each wheel and bearing protector has an annular central concavity from which a central protrusion extends into the central bore of the bearing in position in a bearing-retaining region of the wheel. An adjacent, substantially radially, annular surface is positioned immediately adjacent to a bearing-retaining cavity in the wheel for holding the bearing snugly in the bearing-retaining cavity to prevent loss or damage. A peripheral rim fits snugly about the outer edge on one side of the wheel. A lock rod apparatus for clamping the two protectors together has a T-rod which is extended through a noncircular slot in the two protectors and through the center bore of the wheel. The T-rod is rotated to allow a T-member on one end of the T-rod to engage the outer lip region of one of the protectors. A wing nut may be tightened against the outer lip region of the other protector to clamp the protectors in place. A T-handle, disposed on the other end of the T-rod, is adapted to be located entirely within the annular central concavity volume.

3 Claims, 4 Drawing Figures

AIRPLANE WHEEL AND BEARING PROTECTOR

BACKGROUND OF THE INVENTION

This application is a continuation-in-part of copending application Ser. No. 021,036 filed Mar. 16, 1979, now abandoned.

The present invention relates to protectors for wheels and in particular to a wheel protector apparatus for enclosing and protecting the wheel and bearings in the hub of the wheel from damage during handling to further prevent loss of the bearing during shipping and handling.

In shipping and handling wheels, particularly those used on airplanes, gouging, denting and other damage to the metal of the wheel can occur when other freight comes into contact with the wheel or when the wheel is mishandled in shipment between the main repair facility and the various outlying airports. Such rough handling of the wheels causes cracks and abrasions, thus necessitating a large expenditure of time and money in refinishing, repolishing, testing via X-rays, and the like. In addition, wheels are shipped with the bearings positioned in place about the central bore of the wheel. The rough handling frequently causes the bearings to fall out, resulting in damage or contamination and possibly loss. Thus, in addition to protecting the wheels from being damaged, some means is needed to maintain the bearings in the wheel. Various wheel covers have been devised. For example, some vehicle wheel covers such as those disclosed in U.S. Pat. Nos. 1,589,06; 3,004,798; 1,351,261; 1,928,882; 1,861,432; 1,289,908, and 1,582,595; and in Italian Pat. No. 252274, are adapted to be used while the wheel is mounted to the axle and have been for such purposes as ornamentation or streamlining. In general, however, these covers are attached to only one side of the wheel and cannot be attached to the wheel by fitting a protrusion into the central bore of the wheel to retain the bearing in the central bore region because of the presence of the axle.

In another class of wheel covers, illustrated in U.S. Pat. Nos. 1,234,387; 1,658,696 and 1,712,590, the objective is to provide a carrying space or otherwise protect a wheel with a tire mounted to it. In general, such arrangements do not need to be concerned with retaining bearings in the wheel since the bearings are mounted to the axle rather than with the wheel. In addition, none of the references disclose a central inwardly projecting protrusion which is adapted to be fitted such as by press-fitting into the central bore of a wheel to affect retention of the bearing therein.

The present invention provides a pair of wheel and bearing protectors, hereinafter referred to as wheel protectors, each of which has an inwardly projecting peripheral rim for fitting over the outer edge of the wheel and further provides a central inwardly projecting protrusion which fits into the central bore of the bearing and the wheel. The peripheral rim and central inwardly projecting protrusion preferably fit snugly to the wheel to hold the covers on the wheel until the two protectors are clamped together with, for example, a lock rod apparatus. In addition, the present invention provides a surface adjacent to the bearing cavity to hold the bearing in the bearing cavity to prevent its loss or displacement and consequent damage or loss during handling of the wheel.

Finally, the present invention provides a clamping apparatus such as a lock rod apparatus having a handle on one end and a T-member on the other end whereby the two protectors may be clamped together on opposite sides of the wheel. The clamping may be accomplished by simply passing the end of the rod having the T-member through a noncircular slot in the central portion of each protector and then twisting the rod utilizing the handle so that the T-member cannot be pulled back through the slot. A nut or other clamping mechanism may then be tightened along the rod to pull the two protectors together, thereby clamping them on either side of the wheel.

SUMMARY OF THE INVENTION

The present invention comprises a wheel and bearing protector assembly for protecting an unmounted wheel and a bearing mounted in the central bore of the wheel. The wheel has two annular peripheral edges axially disposed from each other for receiving a tire bead, a central bore for receiving an axle, and a bearing-receiving portion about the central bore for receiving a bearing assembly. The wheel and bearing protector assembly comprises a pair of circular protectors for being positioned on opposite sides of the wheel. Each wheel protector has a central inwardly projecting protrusion for extending into the central bore of the wheel for press-fitting the wheel protector to the wheel. Each protector also has an inwardly projecting peripheral rim for being positioned over one of the annular peripheral edges of the wheel. An annular flange portion with an inwardly directed substantially radial surface adjacent to the central inwardly projecting protrusion is positioned for being adjacent to the bearing receiving portion when the wheel protector has been fitted into the central bore of the bearing and wheel. The annular flange portion so positioned provides a means for retaining a bearing in the bearing-receiving portion.

A wheel protector attachment means is provided for clamping the wheel protectors together on opposite sides of the wheel. The wheel protector attachment means preferably comprises a rod for extending through the center apertures of the wheel protectors and the central bore of the wheel. A releasable connecting means is provided for selectively connecting and disconnecting one end of the rod to one of the wheel protectors. Any appropriate releasably connecting means may be used. A clamping means is then provided to be axially movable along the rod for pressing against the other wheel protector. The two wheel protectors are clamped together on opposite sides of the wheel when the rod is connected to the one wheel protector by the releasable connecting means and the clamping means is tightened to decrease the distance between the two wheel protectors.

In one embodiment, the releasable connecting means comprises a lock rod having a T-member attached to one end of the rod where the length of the T-member is less than the diameter of the central bore of the wheel. In addition, the center aperture of each wheel protector is provided with a noncircular slot portion having a maximum width and a minimum width. The maximum and minimum widths are selected so that the T-member passes through the slot when it is aligned along the maximum width of the slot but is prevented from passing through the slot when it is not aligned with the maximum width of the slot. In operation, the T-member is extended through both wheel protectors and the central bore of the wheel. The handle on the opposite end of the rod is then twisted and the T-member seated in a radial groove impressed in an orientation preferably perpendicular to the orientation of maximum width portion of the slot so that the T-member cannot be withdrawn through the slot. A clamping means such as a nut apparatus is then positioned on the threaded rod so that the two protectors may be clamped together by tightening the nut apparatus.

BRIEF DESCRIPTION OF THE DRAWINGS

A complete understanding of the present invention and of the above advantages may be gained from a consideration of the following description of the preferred embodiments taken in conjunction with the accompanying drawings in which.

DETAILED DESCRIPTION

Figure 1:
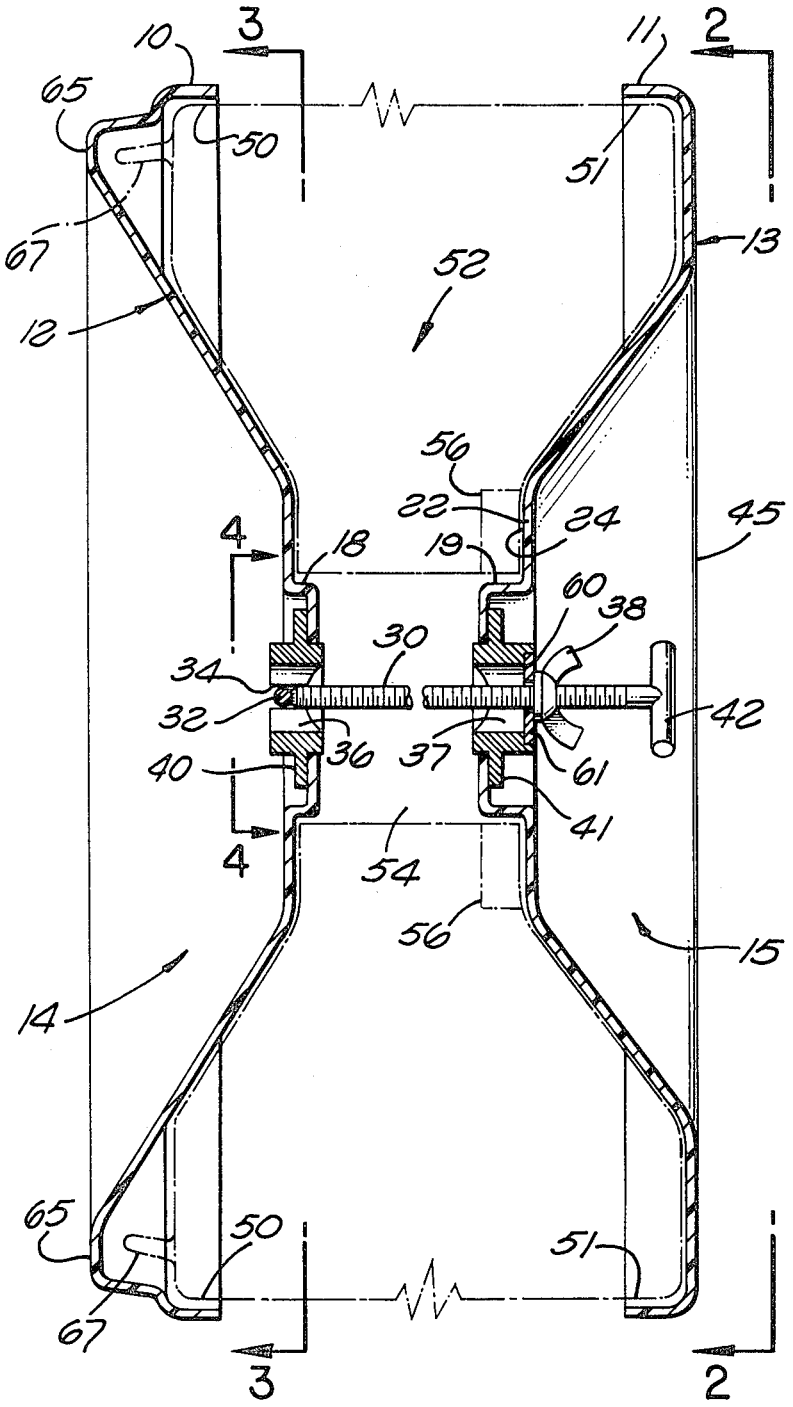
FIG. 1 is a cross-section plan view of one embodiment of the present invention showing both the wheel protectors and the wheel protector attachment means in position about a wheel.
Figure 2:
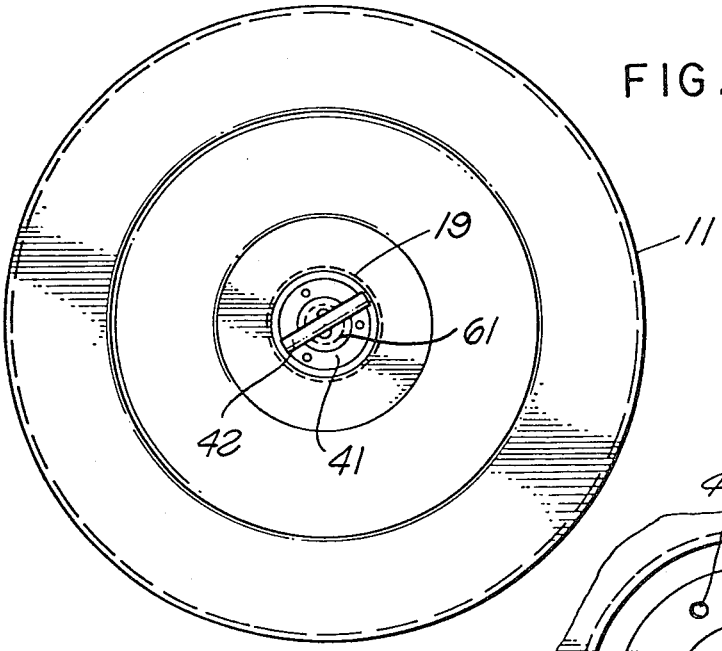
FIG. 2 is a side plan view of the present invention through section 2—2 of FIG. 1.
Figure 4:
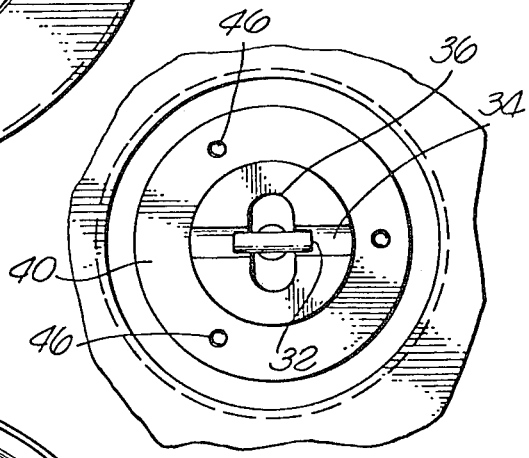
FIG. 4 is a partial side plan view through section 4—4 as shown in FIG. 1.
Figure 3:
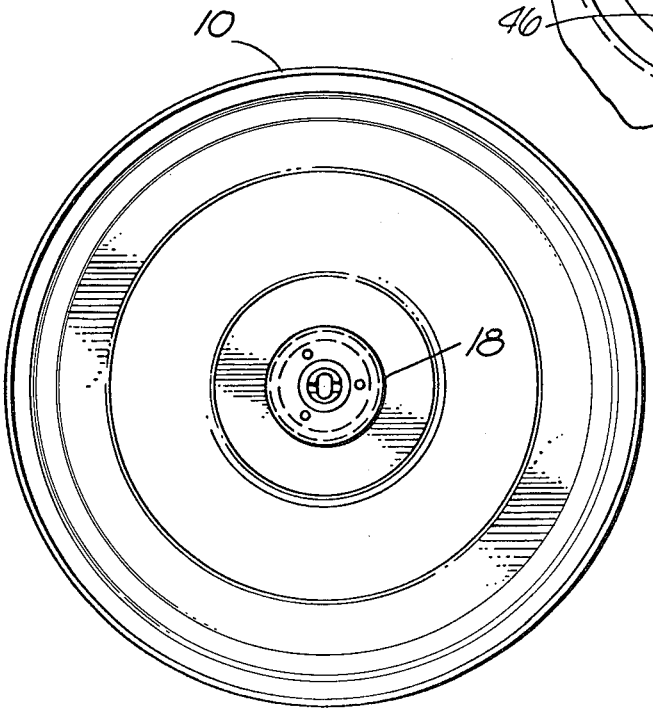
FIG. 3 is a side plan view of the present invention through section 3—3 as shown in FIG. 1.

The present invention comprises a wheel and bearing protection apparatus which is particularly useful to protect the wheel of an airplane on which a tire is mounted and the bearing disposed in a cavity around the center core of the wheel after the wheel and the tire has been removed from the airplane. However, the present invention may also be used in protecting wheels without the tire mounted thereon. Referring to FIGS. 1 through 4, the present invention has a circular inboard wheel and bearing protector 12 and a circular outboard wheel and bearing protector 13. Protectors 12 and 13 have inwardly projecting peripheral rims 10 and 11 respectively which preferably fit snugly around the respective peripheral tire bead receiving edges 50 and 51 of the wheel 52.

Each wheel protector 12 and 13 has a annular concavity 14 and 15 respectively. The central inwardly projecting protrusions 18 and 19 are preferably adapted to fit snugly in the central bore 54 of the wheel when an axle is not extending through the central bore 54. Either one of the wheel protectors may thus be held on one side of the wheel 52 by press-fitting the central inwardly projecting protrusion 18 or 19 into the central bore 54 of the wheel with the inwardly projecting peripheral rim 10 or 11 fitting snugly over the outer tire bead receiving edge 50 or 51 of the wheel 52. Because the protector 12 or 13 preferably fits snugly about the peripheral tire bead receiving edge 50 or 51 with the protrusion 18 or 19 in the central bore 54, the cover 12 or 13 will adhere to the wheel once it has been fitted to the wheel 52.

In most wheels of the type described herein, there is a region 56 generally on the outboard side of the wheel, into which a bearing apparatus (not shown) is positioned. The bearing apparatus is positioned in the region or concavity 56 during shipment to a destination. Thus, the wheel and bearing apparatus must be kept together in some manner so that the bearing apparatus is not lost or displaced during shipment or handling. In order to hold the bearing apparatus in the bearing-mounting cavity 56 to prevent loss or contamination of or damage to the bearing, wheel protector 13 is provided with an annular flange portion 22 having an inwardly directed substantially radial surface 24. Thus, when the central inwardly projecting protrusion 19 is press-fitted into the central bore 54, the inwardly directed substantially radial surface will be positioned immediately adjacent to the bearing mounting cavity 56, thereby providing a means by which the bearing apparatus may be held and retained in the bearing mounting cavity 56. A similar structure may be provided on the wheel protector 12 if an inner bearing apparatus exists in a second bearing mounting cavity on the other side of the wheel. Thus, the wheel has at least one bearing mounting cavity.

In order to clamp the two wheel protectors together on either side of a wheel 52, the central inwardly projecting protrusions are provided with a central aperture 36 and 37 respectively. In one embodiment, the central apertures may be reinforced by reinforcing members or plates 40 and 41 which fit into and are attached about the center apertures through the central inwardly projecting protrusions 18 and 19 respectively. The center apertures 36 and 37 then extend through the reinforcing members 40 and 41 respectively. The reinforcing members 40 and 41 may be made of any suitable material such as a metal or plastic.

The wheel protector attachment means may comprise rod 30 with a T-member 32 fixed by welding or the like to one end of its ends. A handle or grasping means 42, which may also be a T-member of somewhat larger size, may then be attached to the other end of the rod. In the preferred embodiment, the rod is threaded and has a nut such as a wing nut 38 placed thereon. It will be appreciated, of course, that the wing nut 38 must be placed on the threaded rod 30 prior to attaching the T-member 32 to the end of the rod 30.

In order that the T-member 32 attached to one end of the rod 30 will pass through the center aperture 36 of each of the wheel protectors 12 and 13, the center aperture 36 is provided to be an oval or generally rectangular slot (see FIGS. 2, 3, and 4) having a major diameter or width somewhat larger than the maximum length of the T-member 32, and a minor diameter or width smaller than the maximum length of the T-member 32. A radial groove or indentation 34 may then be impressed or formed in the central inwardly projecting protrusion 18 or in the reinforcing member 40 if one is utilized. The radial groove or indentation 34 (see FIG. 4) is angularly displaced from the major diameter of the slot.

In operation, the end of the rod 30 to which the T-member 32 is affixed is extended through the slots 36 and 37 in the respective wheel protectors 12 and 13. When the T-member has passed through the respective wheel protectors 12 and 13, the rod 30 is twisted by rotating the grasping means 42 so that the T-member aligns with and rests in the radial groove or indentation 34. The grasping means 42 is then pulled so that the T-member 32 seats in the radial groove or indentation 34. To maintain this seating arrangement and to clamp the two wheel protectors together on opposite sides of the wheel, the clamping means, which may comprise the wing nut 38 or any other suitable means, is tightened by screwing the wing nut 38 along the rod 30 away from the grasping means 42. Of course, it will be appreciated that the wing nut 38 must be of a sufficient width so that the wing nut will not pass through the slot 36 along the major diameter of the slot.

In this regard, the reinforcing member 41 may have a disc-like indentation 60 into which a washer 61 seats when the wing nut is tightened against the outer surface of the washer 61.

In the preferred embodiment, the grasping means 42 comprises a rod which is attached by welding or the like to the end of the rod 30 opposite the T-member 32. The length of the rod 30 is selected so that when the wheel protectors 12 and 13 are attached on either side of the wheel and the nut apparatus 38 is tightened to clamp the two wheel protectors together, the grasping means 42 will be contained in the annular central cavity 15 within the outermost radial plane 45 of the wheel protector. Thus, the grasping means will be entirely within the volume defined by the outer surface of the annular central cavity 15 and the outmost radial plane 45.

It will be appreciated, of course, that various other clamping apparatus may be utilized without departing from the spirit of the invention. Such clamping means may be oriented at the center of the protectors or at locations about the periphery of the protectors, or at any other suitable or convenient location.

In the preferred embodiment, the wheel protectors are made of plastic and are relatively rigid so as to protect the wheel from being damaged and the bearing from being lost, damaged or contaminated during shipment, handling or the like. However, any other appropriate material may be used. The reinforcing members or plates 40 may be attached to the respective wheel protectors by screws, rivets or the like 46, as shown in FIGS. 1 through 4. In addition, the radial groove 34 may be provided in only one of the protectors.

The particular surface configuration of the wheel protectors may be adapted to fit over any particular shaped wheel. For example, in FIG. 1, the wheel protector 12 is a rearwardly extending peripheral protrusion 65 which is adapted to fit around the thin steel heat shield 67 protruding from the wheels used in the DC10 and L1011 aircrafts. Of course, any other suitable shape could be incorporated without departing from the invention in its broader aspects.

While the present invention has been particularly described and shown with reference to the preferred embodiments, it will be understood by those skilled in the art the foregoing and other changes in form and details may be made without departing from the spirit and scope of the invention.

What is claimed is:

1. An airplane wheel and bearing protector assembly for protecting an unmounted airplane wheel during storage and shipment of the wheel, the wheel having two annular peripheral edges axially disposed from each other; a wheel center bore for receiving an axle therethrough when the wheel is mounted on the airplane; and an annular bearing-receiving cavity adjacent the wheel center bore on at least one side of the wheel having a bearing removably mounted therein when the wheel is not mounted on the airplane, the bearing having a bearing central bore therethrough, the wheel and bearing protector assembly comprising:

a pair of unitary circular protector members for being positioned on opposite sides of the wheel, each protector having a central axis and comprising:

an annular peripheral rim portion for extending axially inwardly toward the wheel and having an annular terminal edge for fitting over the annular peripheral edge of the wheel on one side thereof;

a connecting section extending generally radially from the peripheral rim relative to the central axis at a location remote from the respective annular terminal edge of the wheel and terminating at a first annular location;

a generally frusto-conical shaped section angled axially inwardly from the connecting section to define a concavity in the unitary protector member, the frusto-conical section terminating at an annular corner region to define a radial width of the frusto-conical section between the connecting section and the annular corner region;

an annular flange section extending radially from the annular corner region substantially in a plane perpendicular to the central axis so that the frusto-conical section forms an obtuse angle with the annular flange portion at the annular corner region, the obtuse angle and the radial width of the frusto-conical portion being selected so that the annular flange section of at least one of the protector members is positioned axially immediately adjacent the bearing receiving cavity for holding the bearing in the bearing receiving cavity and preventing axial dislocation of the bearing from the cavity when the peripheral flange is in position over the annular rim of the wheel; and a central protrusion protruding axially inwardly from the innermost part of the annular flange section and having a protector member center bore extending through the central protrusion, the protrusion having an annular portion thereof being insertable into the central bore of the bearing positioned in the bearing-receiving portion of the wheel and immediately adjacent thereto for preventing radial dislocation and contamination of the bearing;

a pair of reinforcing members, each being attached to one of the protector members in the central protrusion thereof and about the peripheral edge of the respective protector member center bore; and attachment means for interconnecting to the pair of reinforcing members for clamping the protector members together, so that the two clamped protector members are positioned on opposite sides of the wheel.

2. The airplane wheel and bearing protector of claim 1 wherein the wheel further includes an axially extending annular heat shield on at least one side of the wheel adjacent one of the annular peripheral edges, one of the unitary circular protector members having an annular protrusion extending from the connecting section for fitting over and protecting the annular heat shield.

3. The airplane wheel and bearing protector of claim 1 or 2 wherein each of the pair of unitary protector members is made of plastic for protecting the wheel from damage and contamination during shipment and handling.

* * * * *